United States Patent [19]

Drutchas et al.

[11] 4,400,144

[45] Aug. 23, 1983

[54] AIR COMPRESSOR

[75] Inventors: Gilbert H. Drutchas, Birmingham; David J. Suttkus, Utica, both of Mich.

[73] Assignee: TRW, Inc., Cleveland, Ohio

[21] Appl. No.: 308,405

[22] Filed: Oct. 5, 1981

[51] Int. Cl.[3] ..... F04B 35/04; F04B 17/08; F04B 21/08

[52] U.S. Cl. ..... 417/415; 417/534; 92/171

[58] Field of Search ..... 417/534–537, 417/ 415; 92/169, 171

[56] References Cited

U.S. PATENT DOCUMENTS

| | | | |
|---|---|---|---|
| 646,031 | 3/1908 | McKinnon | 417/534 |
| 1,362,144 | 12/1920 | Rooney | 417/536 |
| 1,820,883 | 8/1931 | Hueber | 417/534 |
| 2,965,289 | 12/1960 | Weibel, Jr. . | |
| 3,111,259 | 11/1963 | Demay . | |
| 3,246,581 | 4/1966 | Carr | 92/169 |
| 3,781,144 | 12/1973 | Jacobs | 92/128 |
| 3,794,067 | 2/1974 | Beck . | |
| 3,961,869 | 6/1976 | Droege | 92/171 |
| 4,273,519 | 6/1981 | Gannaway | 92/171 |

*Primary Examiner*—William L. Freeh
*Attorney, Agent, or Firm*—Yount & Tarolli

[57] ABSTRACT

An air compressor including a motor, a motor housing, a piston assembly and a piston housing is disclosed. A bracket is located between the motor housing and the piston housing. The piston assembly includes pistons which reciprocate within sleeves upon rotation of a cam driven by the motor. The sleeves are received in U-shaped recesses in the piston housing. The open end of the U-shaped recesses are closed by the bracket. The bracket has tangs which act as springs to urge the sleeves firmly into the housing. The tangs accommodate variations in the dimensions of the housing and the sleeves, as well as provide contact with the sleeves for heat transfer.

10 Claims, 7 Drawing Figures

AIR COMPRESSOR

BACKGROUND OF THE INVENTION

The present invention relates to air compressors.

Known air compressors include a motor and a piston assembly. The piston assembly has at least one piston reciprocated by the motor. The piston or pistons are slidably mounted in bushings or sleeves and are reciprocated in the sleeves by a cam driven by the motor. As the pistons reciprocate, air is drawn into the piston assembly, compressed, and expelled. The motor is located in a motor housing and the piston assembly is located in a piston housing. The piston housing and motor housing are secured together.

The piston housing normally includes cylindrical chambers into which the cylindrical sleeves are assembled by axial movement into the chambers. One end of the sleeve is closed with a cylinder head fastened to the piston housing to form a working chamber. Thus each sleeve is totally encircled by the housing and closed at one end.

In such known air compressors the dimensions of the sleeves and the cylindrical chambers in the piston housing must be kept within a narrow tolerance. It is undesirable to have the outside diameter of a sleeve so much smaller than the inside diameter of its associated chamber that the sleeve cocks in the chamber. In order to avoid cocking of the sleeves, accurate machining of the piston housing and the bushings has been necessary.

The construction of known air compressors requires that other components as well as the sleeves and the chambers in the piston housing be manufactured to relatively close tolerances. If the tolerances are too large, the cumulative effect or stack up of the tolerances can create an assembly problem. For example, the motor has a shaft that is normally supported by a bearing in the piston housing. The shaft is keyed to a cam which drives the pistons back and forth in the sleeves in the piston housing. The piston housing is fastened to the motor housing. If the manufacturing tolerances for each component are not small, assembly can be difficult or impossible with the result that many otherwise acceptable parts are wasted.

The process of compressing air produces much heat. Most of the heat generated by known air compressors is dissipated by conduction from the sleeves through the piston housing to the ambient air. Accordingly, any structure which solves problems relating to the manufacturing tolerances of air compressor components should not detrimentally affect heat dissipation.

BRIEF SUMMARY OF THE INVENTION

The present invention provides an air compressor whose component parts are easily manufactured and assembled. The air compressor of the present invention eliminates the need to maintain the close dimensional tolerances required in the manufacture of previously known air compressors, and yet avoids problems associated with the stack up of tolerances. Further, the foregoing advantages are achieved while maintaining good heat dissipation.

The air compressor of the present invention includes a motor, a motor housing, a piston assembly and a piston housing. The piston housing is fastened to the motor housing. The portion of the piston housing which faces the motor housing is open. The open portion of the piston housing is formed with wells or recesses that receive pistons and sleeves in which the pistons move. Because the wells are not cylindrical chambers, as in known compressors, the pistons and sleeves may be assembled into the piston housing by merely being laid in the open wells, rather than by being slid axially into cylindrical chambers.

When the motor housing and piston housing are assembled together, the axis of the shaft of the motor and the axes of the sleeves lie in a common plane, but are perpendicular to each other. Each well in the piston housing has an arcuate surface which engages the outer surface of a sleeve. The arcuate surface is semi-cylindrical, extending around approximately 180 degrees of the outer surface of the sleeve. The arcuate surface is symmetrical about the plane containing the axes of the motor shaft and the sleeves. A pair of parallel planar surfaces form the legs of the U-shaped wells and lie generally parallel to the plane containing the axes of the motor shaft and the sleeves. These planar surfaces extend from the outer surface of the piston housing and merge with the arcuate surface forming the bottom of each well.

Interposed between the motor housing and the piston housing is a mounting bracket. The mounting bracket closes the open side of the U-shaped wells in the piston housing and includes spring means which, acting radially on the piston sleeves, biases them into engagement with the arcuate surfaces defining the bottoms of the wells in the piston housing. The spring means comprises tangs which are projecting portions of the mounting bracket. Because the tangs are yieldable, they can accommodate dimensional variations in the piston housing and/or sleeves.

The tangs contact the sleeves along their length in a direction parallel to their axes and there is a substantial area of contact between the tangs and the sleeves. The outer periphery of each sleeve has a pair of flats facing away from the arcuate surface of the well in which the sleeve is located. The spring tangs have flat surfaces which engage the flats on the sleeves. Good heat transfer from the sleeves to the spring tangs is assured because there is area contact between the spring tangs and the sleeves and because the mounting bracket extends into the ambient air and provides a large area for heat dissipation.

BRIEF DESCRIPTION OF THE DRAWINGS

Further features and advantages of the present invention will be apparent to those skilled in the art to which the invention relates from the following detailed description of a preferred embodiment of the invention made with reference to the accompanying drawings wherein.

DETAILED DESCRIPTION OF A PREFERRED EMBODIMENT

Figure 1:
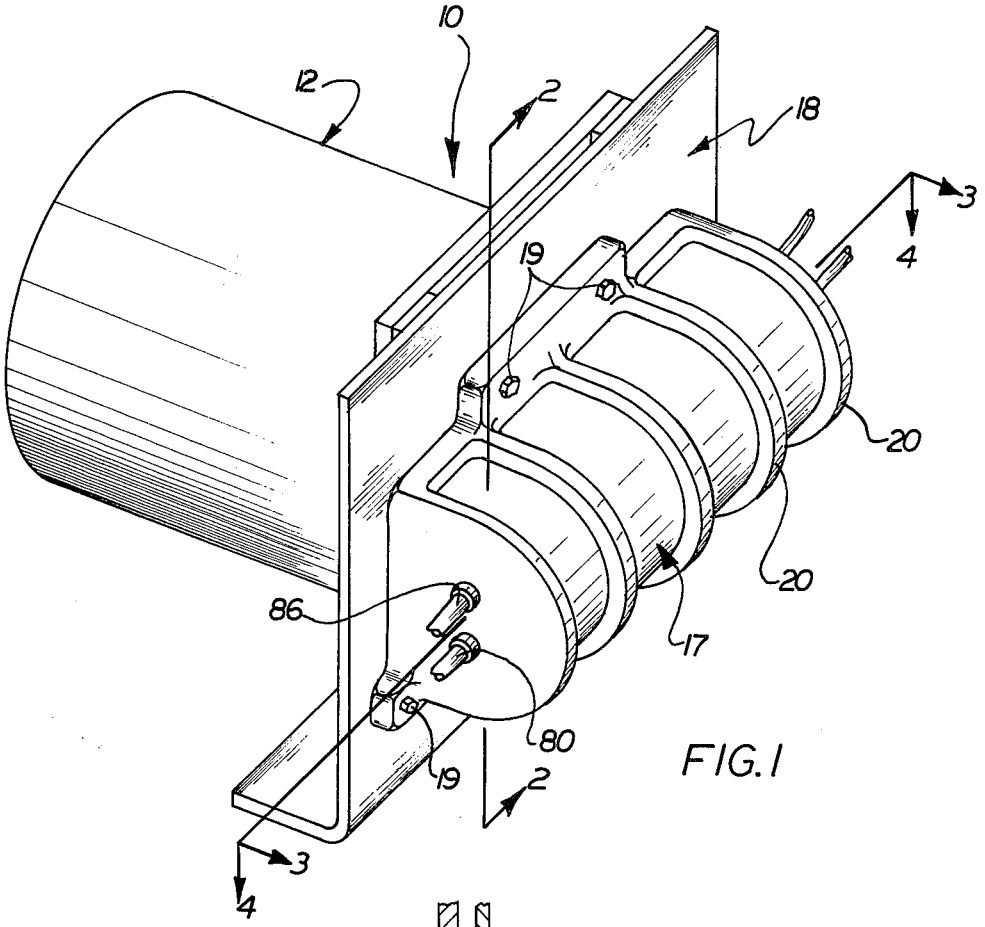
FIG. 1 is a perspective view of an air compressor embodying the present invention.

The present invention relates to an improved air compressor 10 (FIG. 1). The air compressor 10 includes a motor (not shown) located in a motor housing 12. The air compressor also includes a piston assembly 16 (FIG. 3) located in a piston housing 17. A mounting bracket (FIG. 1) 18 is interposed between the motor housing 12 and piston housing 17. The motor housing 12 and piston housing 17 are fastened together on opposite sides of the bracket 18 by means of bolts 19 which extend through the bracket 18. The bracket 18 may be fastened to any suitable support surface.

The air compressor 10 includes means for dissipating the heat generated during the compression of air. To this end, the piston housing 17 includes fins 20 which facilitate dissipation of heat. In addition, heat is dissipated by the surfaces of the bracket 18.

The piston assembly 16 includes two sleeves 30 and 32 (FIGS. 3 and 4) which are positioned within piston housing 17. The piston assembly 16 also includes a double acting piston 36 slidable within the bores of the sleeves 30 and 32. The piston 36 includes a pair of opposite, circular end faces 38 and 40 which together with internal surfaces of the sleeves 30 and 32 and the piston housing 17 define two working chambers 42 and 44. When the piston 36 reciprocates, the working chambers 42 and 44 alternately expand and contract.

The piston 36 includes two generally cylindrical portions 46 and 48 whose ends define the circular end faces 38 and 40, respectively. The cylindrical portions 46 and 48 are tied together by two struts 50 and 52. Cylindrical recesses 54 and 56 are formed in the cylindrical portions 46 and 58, respectively, and extend toward, but do not intersect, the end faces 38 and 40. Rotatable cam followers 58 and 60 are mounted in recesses 54 and 56, respectively.

The piston 36 is caused to reciprocate by rotation of an eccentric cam 62 which is connected with a shaft 64 driven by the motor (not shown). The shaft 64 is rotatably supported in the piston housing 17 by a bearing 65 received in an opening 66 in the housing. The cam 62 is held against rotation relative to the shaft 64 by means of a key 67. The cam followers 58 and 60 are mounted for rotation about axes which are parallel to the axis of rotation of the shaft 64. The cam followers 58 and 60 contact diametrically opposite locations on the cam 62, and when the shaft 64 rotates, the eccentrically mounted cam transmits motion through the cam followers to the piston 36.

Figure 3:
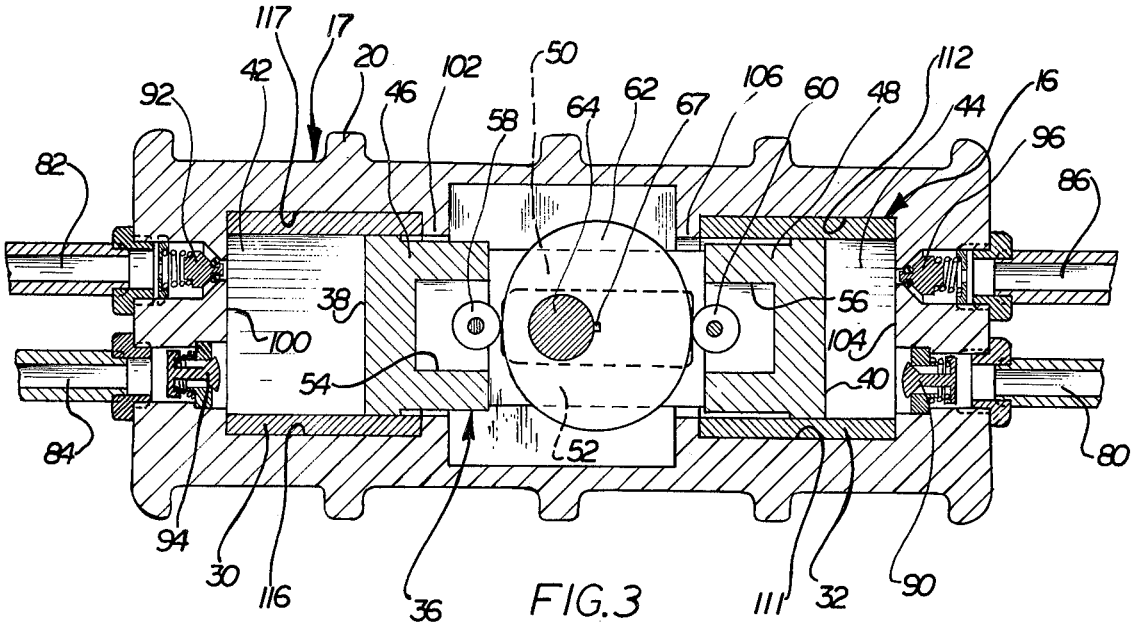
FIG. 3 is a sectional view of the air compressor of FIG. 1, with parts omitted, taken along line 3—3 of FIG. 1.
Figure 4:
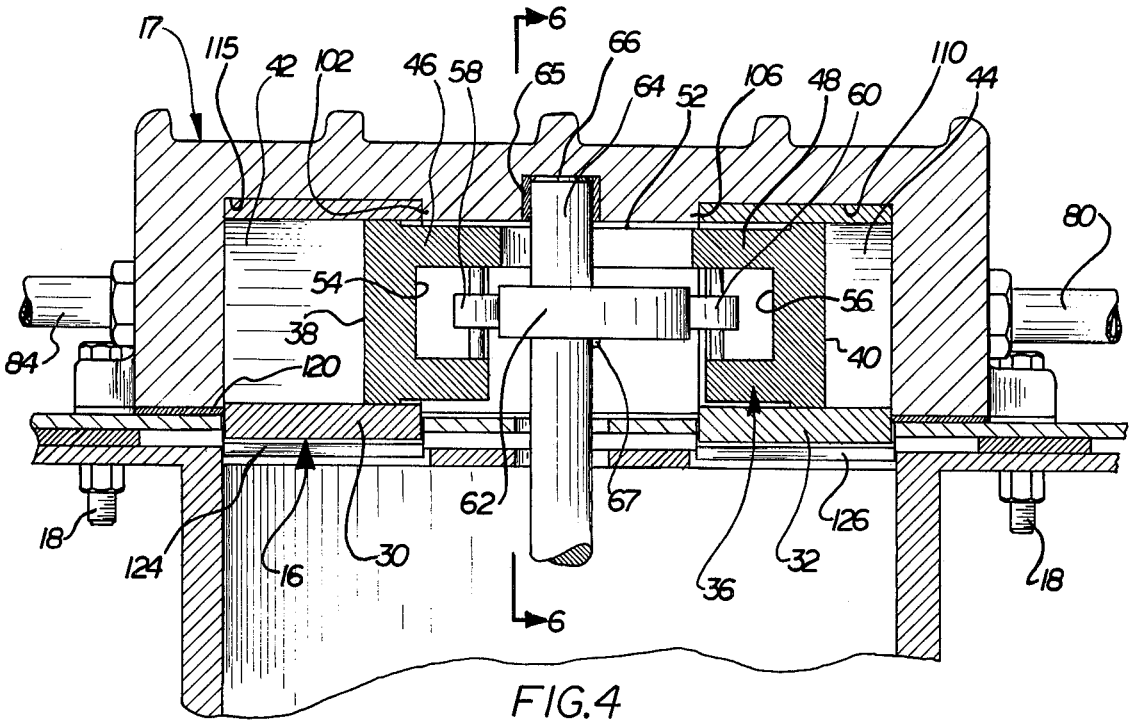
FIG. 4 is a partial sectional view of the air compressor of FIG. 1 taken along line 4—4 of FIG. 1.

When the piston 36 moves in one direction, e.g., to the left as viewed in FIGS. 3 and 4, air is drawn into chamber 44 through inlet 80, and air is expelled from the contracting chamber 42 through the outlet 82. When the piston 36 reaches the end of its stroke and starts to move to the right, air is drawn into the chamber 42 through inlet 84 and expelled from chamber 44 through outlet 86. Conventional check valves 90, 92, 94, and 96 are provided in each inlet and exhaust passage 80–86.

Figure 2:
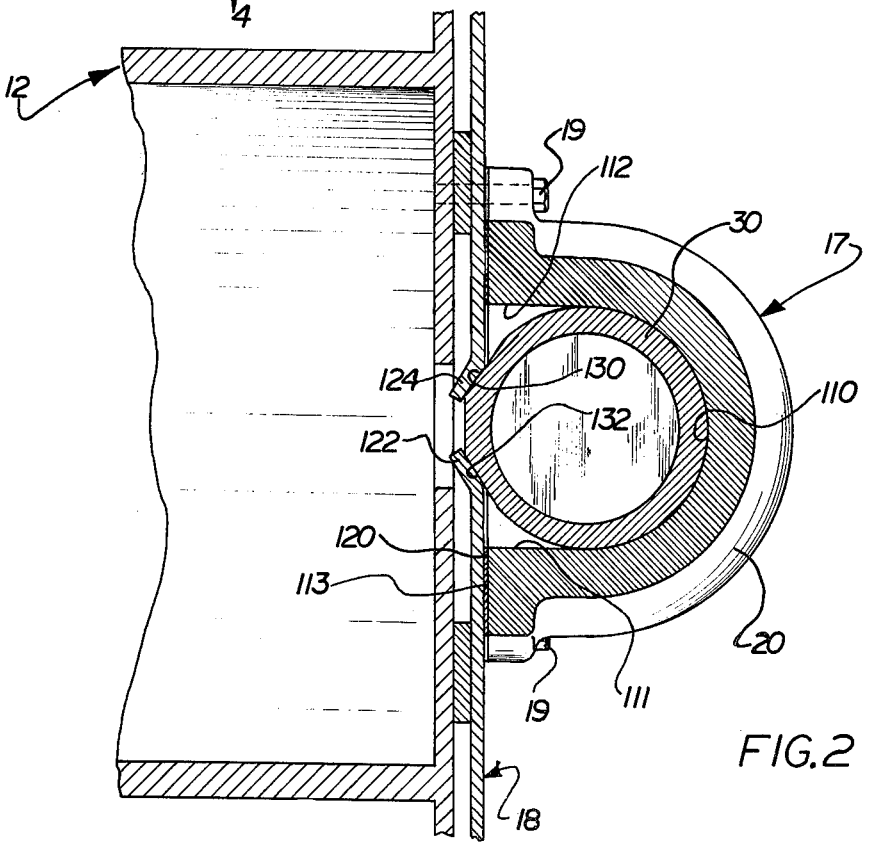
FIG. 2 is a partial sectional view, with parts omitted, of the air compressor of FIG. 1 taken approximately along line 2—2 of FIG. 1.

The compressor 10 is designed to be easy to manufacture and assemble. The piston housing 17 (FIGS. 2 and 5) includes two U-shaped wells 97 and 98 into which the sleeves 30 and 32, respectively, (FIG. 3) may be inserted. This makes assembly considerably easier than pressing a sleeve axially into a cylindrical housing.

The piston housing 17 has surfaces which hold the sleeves 30 and 32 against axial movement within the housing. Specifically, the sleeve 30 (FIG. 3) is held against axial movement by end face 100 of the piston housing 17 and by a ridge 102 which extends radially inward into the U-shaped opening in the housing. Similarly, the sleeve 32 is restricted against axial movement by the end face 104 of the housing 34 and by ridge 106 which is generally similar to ridge 102. Therefore when the sleeves 30 and 32 are inserted into the piston housing 17, the faces 100 and 104 and ridges 102 and 106 restrain them against axial movement. Further, because end faces 100 and 104 are integrally formed with the piston housing 17, separate cylinder heads are not required.

Figure 5:
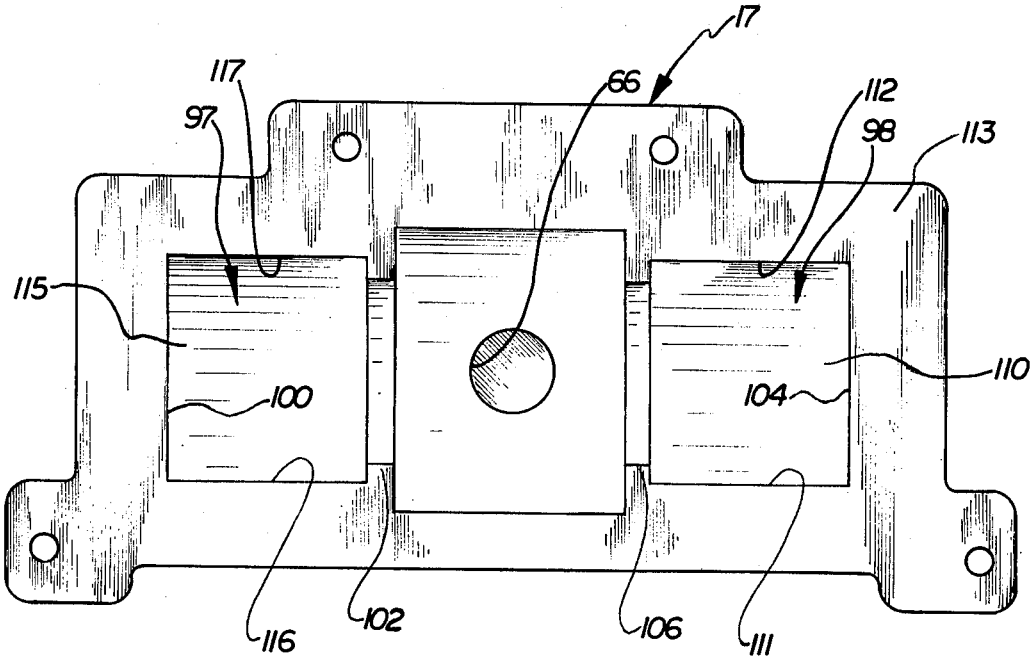
FIG. 5 is a view of a piston housing for the air compressor of FIG. 1 without parts assembled in the housing.
Figure 6:
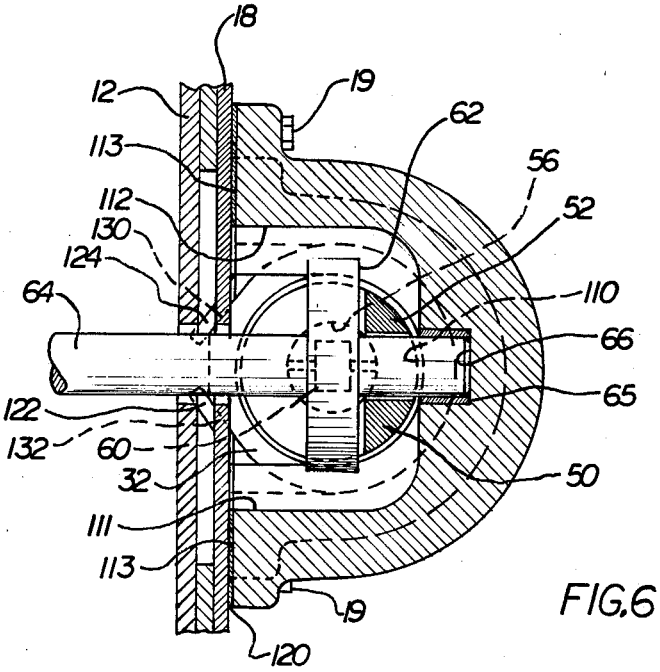
FIG. 6 is a sectional view taken along line 6—6 of FIG. 4.

The curved portion 110 (FIGS. 2 and 5) of the U-shaped well or opening 97 in the housing 34 is curved with the same or a slightly larger radius of curvature as the outside of the sleeve 32 (FIG. 3), and therefore there is tight engagement between about one-half of the exterior perimeter of the sleeve 32 and the housing 34 along the entire axial length of the sleeve from end face 104 of the housing to ridge 106. The sleeve 30 is similarly received in the well 97 (FIG. 5). The wells or openings 97 and 98 are located so that with a gasket 120 (FIG. 6) in place between the piston housing 17 and the bracket 14 when the bolts 19 are tightened, the sleeves 30 and 32 are pressed firmly against the mounting bracket 18. Thus, the curved portion 110 of the well 98 and the curved portion 115 of the well 97 cooperate with the bracket 18 to hold the sleeves 30 and 32 against radial movement.

The legs 111 and 112 of the U-shaped well 98 (FIGS. 5 and 6) are planar and extend parallel to the axis of the curved portion 110. The legs 111 and 112 terminate at planar surface 113 which is parallel to the axis of the semi-cylindrical portion 110 of the U-shaped opening in the housing 34. The well 97 is similar with a semi-cylindrical portion 115 coaxial with the corresponding portion 110 and legs 116 and 117 parallel with legs 111 and 112. The planar surface 113 defines the depth of the U-shaped openings 97 and 98 in the piston housing 17.

Figure 7:
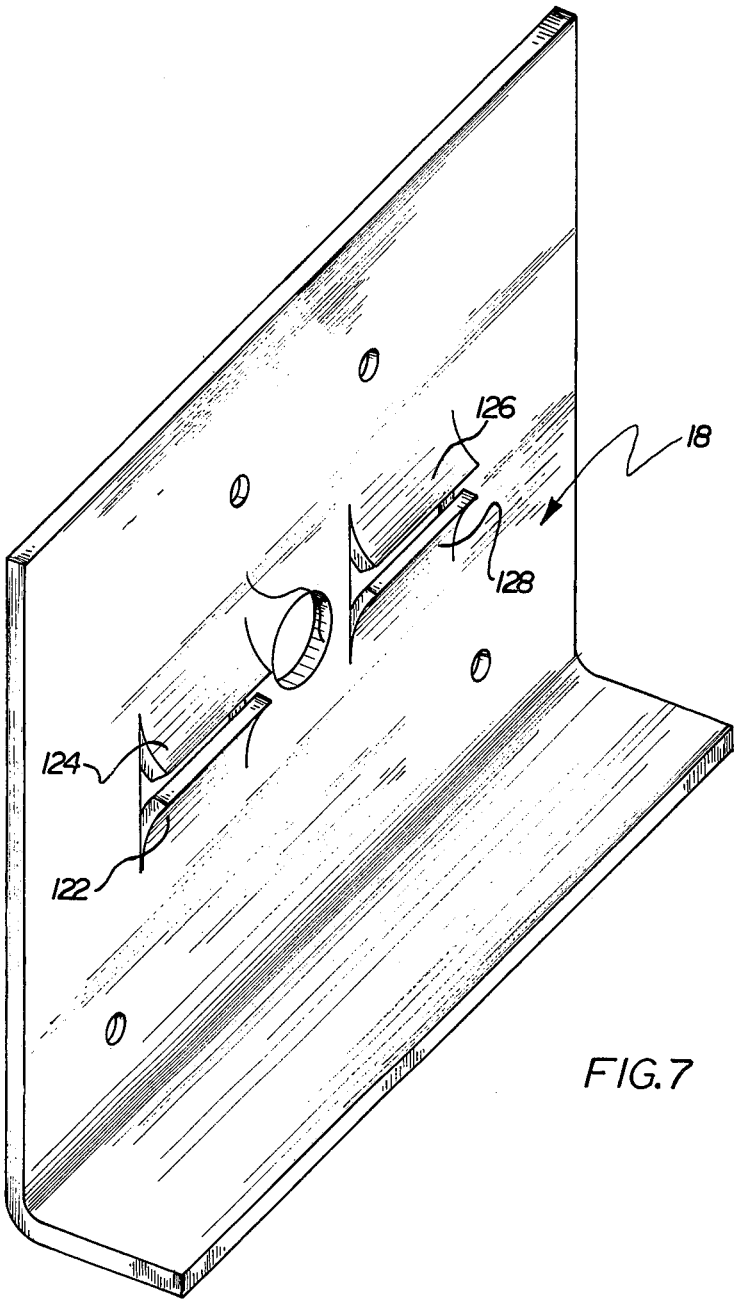
FIG. 7 is a perspective view of the mounting bracket of the air compressor of FIG. 1.

The mounting bracket 18 includes tangs 122, 124, 126, and 128 (FIG. 7) against which the sleeves 30 and 32 press. The tangs 122–128 yield slightly when the bolts 19 are tightened to press the sleeves 30 and 32 (FIG. 4) firmly into the curved portions 110 and 115 of the U-shaped wells in the piston housing 17. Moreover, the mounting bracket 18 (FIG. 7), including the tangs, is formed of a material with a relatively high yield point so that the tangs have spring-like qualities. For this reason, if the spacing between the axial centerline of the curved portions 110 and 115 of the wells 97 and 98 (FIGS. 2 and 5) in the housing 17 is not exactly the desired distance from the planar surface 113, the tangs 122–128 still serve to press the sleeve into the housing. If the outside diameter of the sleeves 30 and 32 is too large or too small, the tangs 122–128 will yield accordingly. In effect, the tangs accommodate dimensional inaccuracies in the housing or the sleeves 30 and 32.

Each tang 122, 124, 126 and 128 is bent slightly out of the plane of the bracket 18 during initial manufacture. Thus, each pair of tangs 122, 124 and 126, 128 forms a V against which a sleeve 30 or 32 may press. The sleeves 30 and 32 are formed with flats 130 and 132 (FIG. 2) which are disposed at approximately the same angle to each other as tang 122 is to tang 124 and tang 126 is to 128. The flats 130 and 132 (FIG. 6) are symmetrical about a plane containing the axis of shaft 64 and the common axis of sleeves 30 and 32. The sleeves 30 and 32 make not just line contact with the tangs 122–128, but rather there are substantial areas of contact between the flats 130 and 132 and the tangs which faciliate heat transfer between the sleeves and the tangs.

Although the present invention has been described as a motor driven air compressor, it is clear that the housing 17 and the bracket 18 with yieldable tangs 122–128 to secure a cylinder sleeve 30, 32 could advantageously be used in other applications. For example, this structure may also be used in pumps for incompressible fluids or in motors which are driven by fluid under pressure. Moreover, there are many slider-crank type mechanisms which are the equivalent of the cam and cam followers illustrated in the preferred embodiment.

The following is claimed:

1. A fluid compressor comprising
a motor having an output shaft,
a piston housing having in it at least one recess,
a sleeve located in said recess, said sleeve having an axis extending transverse to said output shaft,
a piston located and reciprocable in said sleeve upon rotation of said output shaft,
bracket means for mounting said motor interposed between said motor and said piston housing,
resilient spring means acting between said bracket means and said sleeve and applying a biasing force against said sleeve acting in a direction transverse to the axis of said sleeve and holding said sleeve in the recess in said piston housing.

2. A compressor as defined in claim 1 wherein said resilient spring means comprises spring tangs projecting outwardly from said bracket means and formed of the material of said bracket, said spring tangs having surface areas engaging surface areas of said sleeve.

3. A compressor as defind in claim 2 wherein the surface of the piston housing which faces the motor has an arcuate portion that at least partially defines said recess and said sleeve has an arcuate outer peripheral surface portion which engages said arcuate surface portion of the piston housing, said surface areas of said sleeve which are engaged by said spring tangs comprising flats located on the outer peripheral surface of said sleeve.

4. A compressor as defined in claim 3 wherein said flats are located equal distances on opposite sides of a plane defined by the axis of said motor output shaft and the axis of said sleeve and said flats extend at equal angles relative to said plane.

5. A compressor for fluids comprising:
a motor including an output shaft rotatable about a longitudinal axis;
a piston housing into which said output shaft extends, said piston housing having a surface that faces the motor and that defines a recess in said piston housing;
a tubular sleeve located in the housing recess and having a longitudinal axis extending transverse to and in a common plane with the axis of said output shaft;
a piston reciprocable in said sleeve; and
spring means engaging an outer surface of said sleeve and pressing said sleeve into engagement with said surface that defines said recess, said spring means acting in a direction generally parallel to the axis of said output shaft and holding said sleeve in said recess.

6. A compressor as set forth in claim 5 further including a bracket disposed between said motor and said piston housing, said bracket including said spring means.

7. A compressor as set forth in claim 6 wherein said spring means includes resilient spring tangs projecting outwardly from said bracket and formed of the material of said bracket, said spring tangs having surface areas engaging surface areas on the outer periphery of said bushing.

8. A compressor as set forth in claim 7 wherein said sleeve has an arcuate outer peripheral surface portion which throughout its length and for approximately 180 degrees about its circumference engages said surface that faces said motor, and wherein said surface areas of said sleeve which are engaged by said spring tangs comprise flats located on the outer peripheral surface of said sleeve.

9. A compressor as set forth in claims 5 or 8 wherein two sleeves are located in the piston housing and have a common axis extending transverse to the axis of said output shaft, and wherein each sleeve contains a piston reciprocable in said sleeve.

10. A compressor as set forth in claim 9 wherein said surface that defines a recess in said piston housing includes surface means for limiting axial movement of said sleeves relative to said piston housing.

* * * * *